United States Patent [19]

Tan

[11] Patent Number: 5,017,099

[45] Date of Patent: May 21, 1991

[54] FLUID REGULATOR VALVE

[75] Inventor: Jinglu Tan, St. Paul, Minn.

[73] Assignee: Regents of the University of Minnesota, Minneapolis, Minn.

[21] Appl. No.: 518,810

[22] Filed: May 4, 1990

[51] Int. Cl.[5] ..... F04B 49/00

[52] U.S. Cl. ..... 417/307; 417/311; 60/415; 91/454; 137/114

[58] Field of Search ..... 417/304, 309, 311; 60/413, 415, 418, 468; 91/433, 442, 454; 137/114, 488, 907

[56] References Cited

U.S. PATENT DOCUMENTS

| | | | |
|---|---|---|---|
| 2,342,001 | 2/1944 | Magnuson | 417/311 |
| 2,582,626 | 1/1952 | Escher | 137/488 |
| 4,120,480 | 10/1978 | Ando et al. | 137/907 |
| 4,204,584 | 5/1980 | De Marght | 60/413 |
| 4,367,767 | 1/1983 | Hurd | 137/489 |
| 4,743,169 | 5/1988 | Funakawa et al. | 417/306 |

*Primary Examiner*—Leonard E. Smith
*Assistant Examiner*—Alfred Basichas
*Attorney, Agent, or Firm*—Kinney & Lange

[57] ABSTRACT

An energy saving vacuum/pressure regulator is installed between a pump and a load for the pump, such as a storage tank, and relieves the load on the pump when the fluid in the load has reached a desired pressure state. The pressure state can be either negative pressure, or positive pressure relative to the environment. The regulator relieves the pump automatically, so that the energy consumed during variable usage of the fluid is reduced.

16 Claims, 2 Drawing Sheets

FLUID REGULATOR VALVE

BACKGROUND OF THE INVENTION

The present invention relates to a gaseous fluid regulator valve that reduces the energy requirements in a gas system where a pump will provide fluid at a pressure differential relative to an ambient pressure to a load. When using the regulator, the pump can run continuously but will not be under a working load except as the gas usage requires.

Various pneumatic systems having mechanical gas pumps are in use, and attempts to improve the overall system efficiency have concentrated on improving the pump efficiency. Pump efficiency is limited by the structure and type of operation of the pump itself and no substantial improvements can be realized. Efficiencies further can be improved by varying the pump rotation speed or displacement in a simple on/off, step wise or continuous fashion on the basis of demand for the fluid that is being pumped. Variation of the pump rotation speed or displacement is not always feasible because of the limitations on the system size, and type, and the costs of having controls for the functions. Most of the pneumatic systems use a pump with a constant throughput, that is, the pump has a constant volume displacement and runs at a constant speed. A pressure regulator or relief valve set at a particular pressure is used in such operation to control the system pressure. The pump will operate against the pressure controlled by the regulator so that there is a nearly constant pressure differential between the discharge and the intake sides of the pump. Thus, the power input to the pump is nearly a constant though the demand for the fluid is generally variable and even zero at times. In a vacuum system of course the system pressure is on the low pressure side of the pump and the pump operates against ambient pressure.

SUMMARY OF THE INVENTION

The present invention operates on the principal of reducing differential pressure between the high and low pressure sides of the pump to levels so that the pressure will substantially equal, for example, both being at atmospheric pressure when the system pressure reaches a desired level. This can be done whether the system is vacuum or pressure type. The regulator of the present invention permits operation in a reliable, trouble-free and efficient manner.

The regulator of the present invention has two internal valves, which are simultaneously controlled so that in one state of the regulator flow connection is made from the load to the pump through a first open valve while a second valve is closed and in the other state of the regulator the valve to the load is closed and the pump is connected to ambient pressure at both its inlet and outlet through the opened second valve. This will relieve the pump, and greatly increase efficiency during times when the demand for fluid is low. When there is a need for pumping because of demand for such fluid, the valves of the regulator will be moved back to first-state positions described above. The regulator of the present invention finds great utility in systems where there is variable demand for fluid.

DETAILED DESCRIPTION OF THE PREFERRED EMBODIMENTS

Figure 1:
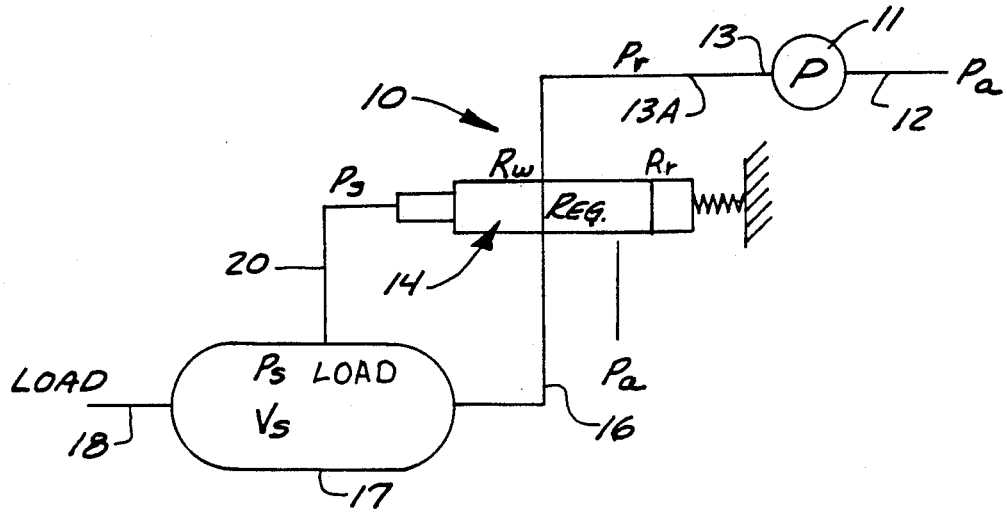
FIG. 1 is a schematic representation of a pneumatic system having a regulator made according to the present invention installed thereon.

FIG. 1 schematically illustrates a typical pneumatic system 10 that utilizes a regulator of the present invention and includes a pump 11, that can be either a vacuum pump or a positive pressure pump. Pump 11 has a first connection 12, and a second connection 13. The second connection 13 is connected to a line 13A. The line 13A from one of the pump connections passes through a regulator indicated at 14 made according to the present invention, as will be fully explained, which has a working position, represented by Rw, and a relief position that is represented by Rr. The second connection 13 of the pump 11 is connected to the regulator and through the regulator to a line 16 that leads to a load 17. The load 17 operates at a system pressure Ps and has an internal volume Vs. A port 18 represents all pneumatically operated, fluid-using devices in the load 17.

A feedback line 20 is connected to load 17 and is utilized for providing a control pressure back to a part of the regulator 14 in the preferred embodiment of the present invention The load 17 can either be a vacuum or pressure system, and the principals of the present regulator accommodates both types of fluid systems. The regulator has a second state wherein the regulator connection to the load is closed and the line 13A is connected through relief connection Rr to ambient pressure Pa.

Figure 2:
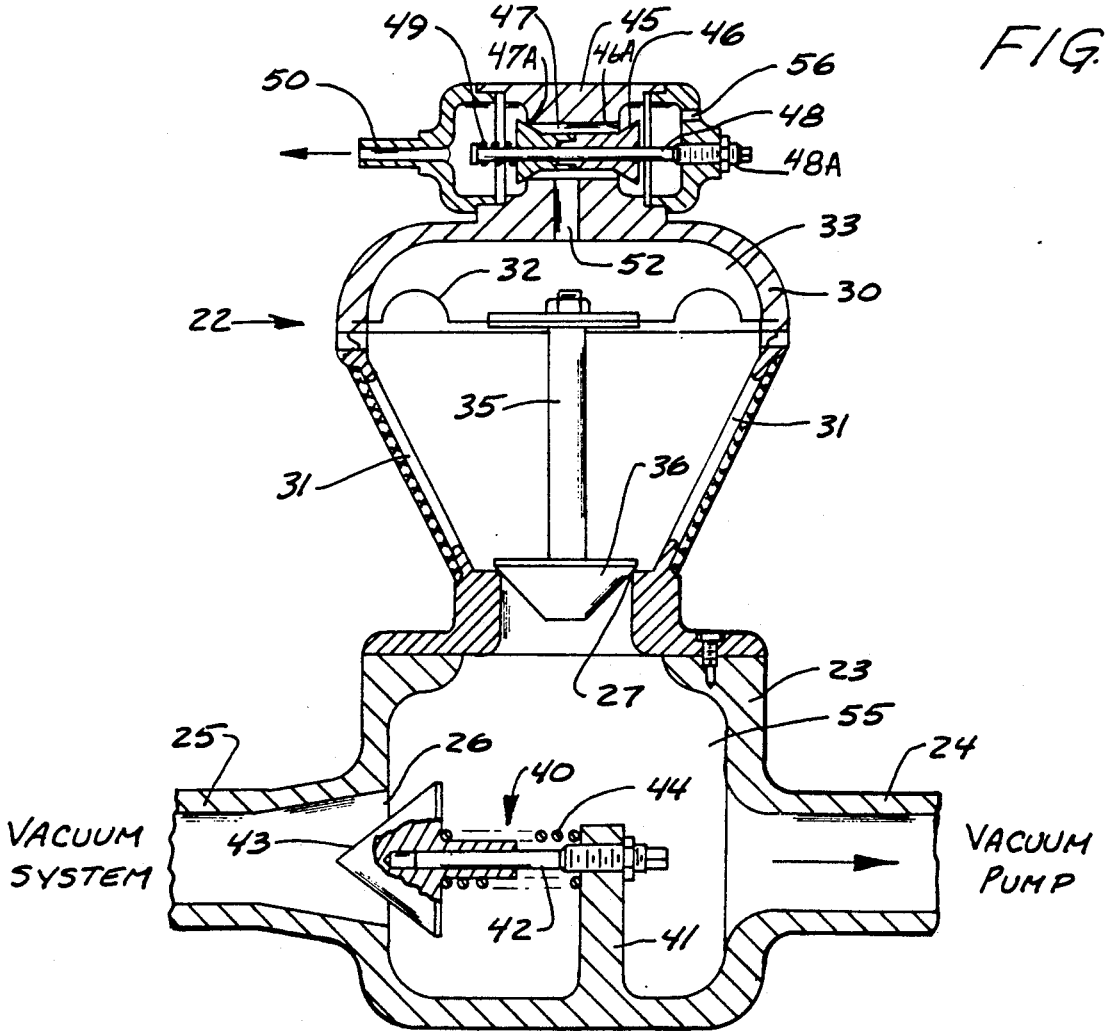
FIG. 2 is a sectional view of a regulator of the present invention utilized in connection with a vacuum system, where the load is vacuum type.

FIG. 2 illustrates details of a typical regulator 14, and this form of the regulator is indicated generally at 22. It includes a housing 23 that comprises a double valve housing. A fitting 24 connects to the second connection 13 of the pump 11 through the line 13A. The regulator 22 is a vacuum system regulator and the suction or low pressure side connection of the pump is connected to connection 24. The regulator body 23 has a vacuum outlet connection 25 that leads to the line 16 and to the load 17.

The body 23 has an working port 26 leading to the connection 25, and has a second relief port 27 that leads through a housing section or chamber 30 and through openings 31 covered with suitable screens (for filtering) to ambient pressure.

The housing section 30 further has a control diaphragm, 32 therein, which is highly flexible and which forms, with part of the housing section 30, control chamber 33 that is closed with respect to the opening 31. The diaphragm 32 also carries and controls movement of a valve assembly, which can be called a relief valve 35, valve 35 includes a valve head 36 that seals around a port 27 when it is in its closed position shown in FIG. 2. The head is attached to a stem which is connected to the diaphragm 32.

The working port 26 is the port that leads to load, and in a vacuum system, any flow from the load would be through the port 26 toward the connection 24 leading to the vacuum pump. A valve assembly 40 is provided for controlling the opening and closing of port 26 and it is supported on a support leg or block 4 formed in the housing. The valve assembly 40 includes a stem 42 which is mounted in the support 41, and a valve head 43 slidable on the stem and movable from an open position to a closed position against the edges of the port 26 when the valve moves to the left in FIG. 2. A very light spring load by a spring 44 can be provided tending to urge the valve head against the port 6 when the port 26 is closed.

The position of the relief valve 35 and its valve head 36 is controlled by the diaphragm 32. The diaphragm 32 is operated through a pilot shuttle valve assembly 45 that is mounted on the housing section 30. Pilot shuttle valve assembly 45 has a small shuttle spool valve 46 slidably mounted in a bore 47 in the valve housing 45, with a support rod 48 screwed into housing 45. The bore 47 can be open to a pilot connection 50 through a port 47A or open to the environment through a port 46A and a passageway 56. A spring 49 tends to urge the shuttle spool to the position shown in solid lines in FIG. 2. The setpoint of the regulator, that is determined by the urging force exerted by the spring 49 on the shuttle spool 46, is adjusted by turning the support rod 48 and secured by tightening a nut 48A.

With vacuum or suction being provided at the connection 24, the valve head 36 will be drawn down against the port 27, and the valve head 43 will be drawn to its open position. The pilot connection indicated at 50 is connected to the load 17 and provides the negative pressure from the load through the line 20 as shown in FIG. 1. When the system pressure Ps is at such a negative value that the preset urging force of the spring 49 is overcome, the shuttle valve 46 will be moved to the left to open the port 47A and close the port 46A causing vacuum to be provided to the bore 47, and through a passageway 52 into the chamber 33 to lift the diaphragm 32 and the connected valve head 36 upwardly as shown in FIG. 2, and open the port 27. This will cause ambient fluid to be drawn in to a chamber 55 through the screens or filters 31, and the increase in pressure in chamber 55 will cause the valve head 43 to move to the left and close the port 26. The volume in the interior chamber indicated at 55 inside the housing 23 is made quite small, so that once the valve 36 starts to open the working connection side of the pump will immediately be relieved of its load, and the closing of the valve head 43 insures that there is no fluid flowing into the load 17 through the port 26. The negative system pressure Ps of the load 17 is held within a tolerable range by the capacitance of the large internal volume Vs of the load.

When the pressure in the load again becomes less negative, the shuttle valve 46 will move under the urging of spring 49 to close off the vacuum source for bore 47. The shuttle valve opens the passageway from the bore 47 to ambient pressure through a small port 56 causing the diaphragm 32 to be relaxed and causing the valve head 36 to close because of the greater ambient pressure acting on it compared to chamber 55, and thereby it is urged toward the port 27. The valve 40 will move to its open working state and the pump will provide vacuum to the load.

Thus on a vacuum system, the alternate action of the relief valve head 36 and the working valve head 43 is such that the working valve is open when the relief valve 36 is closed, and likewise when the relief valve 36 is open to ambient pressure to relieve the pressure differential on the pump, the working valve head 43 immediately closes until such time as the valve head 36 is again closed.

Figure 3:
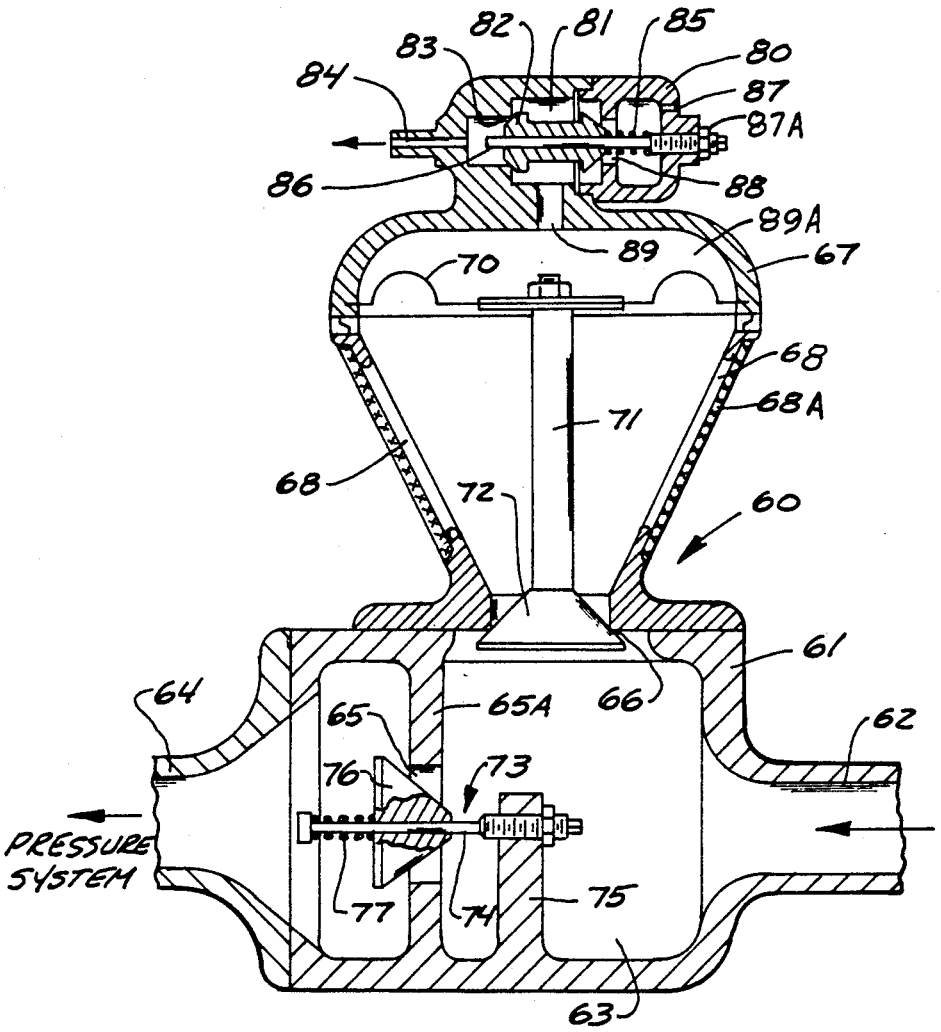
FIG. 3 is a cross-sectional view of a regulator illustrating structure used when the load is pressure type.

FIG. 3 illustrates a modified regulator that is arranged to be used in connection with a pressure system. The regulator shown at 60 includes a housing 61 that has an inlet or pump connection that leads to a pump working connection, which will provide pressure to the housing 61. The housing 61 has an interior chamber 63, and an outlet load connection 64 that leads to the load through a line such as that shown at 16.

The chamber 63 has a divider wall forming a port 65 therein. A relief port 66 is also provided in the housing open to chamber 63. The port 66 leads to a housing section 67 that has an opening 68 covered by screens or filters 68A and open to ambient pressure.

The housing 67 also supports a control diaphragm 70 that has a valve 7 attached thereto with a valve head 72 that seats on the edge of port 66 in the closed position to prevent fluid communication from the chamber 63 to the environment. The diaphragm 70 is a flexible control diaphragm made in a well known manner, and it forms a control diaphragm for the relief valve head 72.

The outlet or working port 65 is formed in a wall section 65A of the housing and has a valve assembly 73 controlling working fluid flow. The valve 73 has a fixed support rod 74 mounted on an upright support 75 formed in the chamber 63. The rod 74 is held stationary and has a valve head 76 slidably mounted thereon and urged toward the port 65 with a very light spring 77. When there is working pressure in the chamber 63 from the pump, connected through the connection 62, the relief valve head 72 is moved against the seat 66 to be closed, and the working valve head 76 will be open because of the pressure in the chamber 63 so that the fluid under pressure is provided to the load through the connection 64. This is the working position of the regulator, with the outlet or working valve open and the relief valve closed.

A pilot valve housing 80 is mounted on the housing 67 and includes an interior bore or chamber 81 that has a shuttle spool valve 82 mounted in it. The bore 81 can be open through a port 83 to a pilot pressure passageway 84 that connects to the pressure system load through line 20 in FIG. 1 for example. The shuttle spool 82 is slidably mounted on a support rod 86 screwed into housing 80 and the spool 82 is urged to close the port 83 with a spring 85 which tends to slide the shuttle leftwards (as shown) along the support rod 86. The setpoint of the regulator, which depends on the urging force of the spring 85 on the spool 82, is adjusted by turning the support rod 86 and secured by tightening a nut 87A. The shuttle spool has a separate valve that opens a port 88 in the position shown in FIG. 3, which provides ambient pressure from a passageway 87 through the port 88. The port 88 is at the opposite end of the shuttle bore 81 from port 83. Ambient pressure is provided through a passageway 89 and the bore 81 to a chamber 89A formed by the diaphragm 70 and part of the housing 67.

In operation, when pressure is being supplied by a pump to the connection 62, the chamber 63 will be pressurized, and assuming that the system pressure is below a selected level determined by the setpoint, the shuttle spool 82 will be urged to close the port 83 and open the port 88, as shown, and ambient pressure will be present above the diaphragm 70. This will cause the valve head 72 to close on the port 66 and the valve head 76 to open to provide pressure through the working connection 64 to the load 17. When the pressure in the load exceeds the desired level, pressure in the passageway 84 will act on the shuttle spool valve 82 to cause it to move away from the port 83 and close port 88, and provide pressure through passageway 89 to the chamber 89A above the diaphragm 70 forcing the valve head 72 away from the port 66. This will reduce the pressure in the chamber 63 and cause the valve head 76 to be forced closed against the port 65 while the connection 62 will then be connected through the port 66 and opening 68 to the environment to reduce the differential pressure between the high and low pressure sides of the pump.

Figure 4:
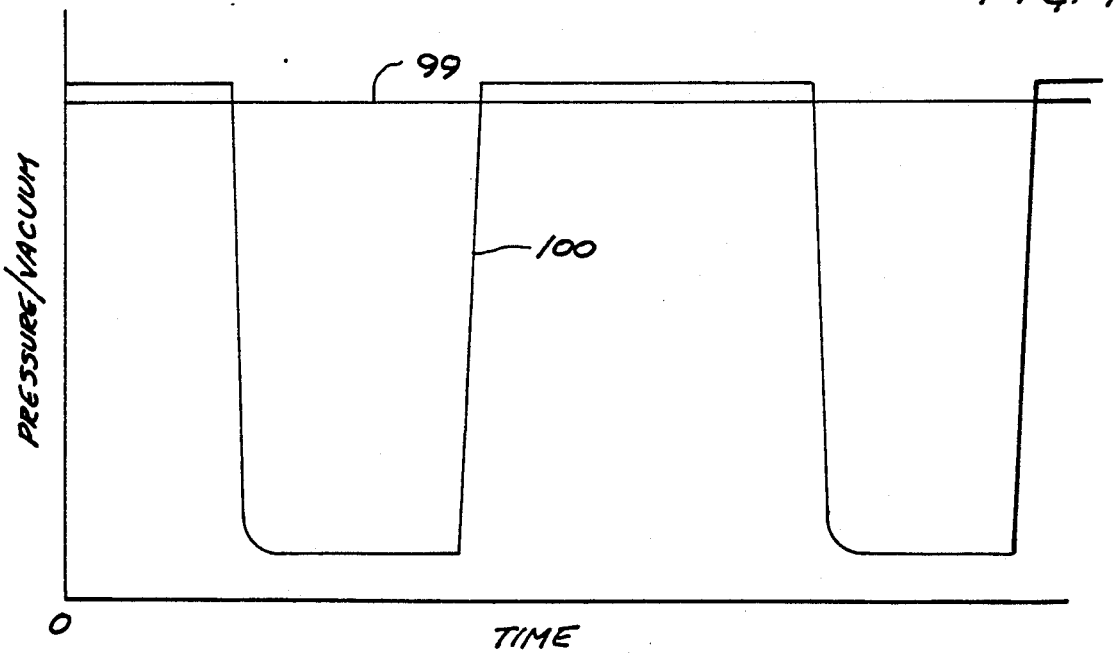
FIG. 4 is a graphic representation of the difference between the energy requirements of the present system and a conventional system.

Reducing the pressure differential between the two pump connectors will cause a reduction in the amount of energy consumed over time as illustrated in FIG. 4. The curve in FIG. 4 indicated at 99 shows the pressure or vacuum on the working side of the pump 11 when a conventional regulator or relief valve is used. The differential pressure between the pump connections is not relieved and the pump is always working against the high pressure differential between its input and output (suction and pressure) connections. The area under curve 99 down to the timeline represents energy consumed by a conventionally regulated system.

The plot indicated at 100 shows the pressure or vacuum on the working side of the pump 11 when the regulator of the present invention is used. When the regulator opens the relief valve and closes the working valve, the working side pressure or vacuum moves sharply to a very low level and continues at this low level until the load demand is such that the regulator valves change position and then the pressure or vacuum rises rapidly. The area below the curve represents energy consumed by a system using the present regulator. It can be seen that energy consumption is substantially reduced with the regulator of the present invention.

The working side connection of the pump could either be the suction or pressure side, depending on whether it is a vacuum system or a pressure system.

While the valves shown in FIGS. 2 and 3 are pneumatically operated, they can also be mechanically or electronically operated. For example, pressure or vacuum sensors can be used to measure the load pressure or vacuum (Ps) and to activate solenoids that will position any one or all of the valves in the complimentary manner described, that is, when the working valve 40 or 73 is open the relief valve 35 or 71 is closed or vice versa. Of course, if the working and the relief valves are directly solenoid-operated, the pilot valve will not be needed.

The steady state pressure difference between the pump working side and the environment when the relief valve is open is the pressure drop across the relief valve port, and this drop can be made quite small by sizing the relief valve port 27 or 66 large enough. The compression ratio of the pump, when relieved, is close to unity. That is, the differential pressure is substantially zero, and the power consumption drops to a low and essentially negligible level. The internal volume of the regulator 55 or 63 can be sized on the basis of the sizes of the pump and the relief valve opening to obtain desirable sharpness or smoothness with which the pressure or vacuum in the regulator chamber will approach the ambient or load pressure (or vacuum) after the relief valve is opened or closed. Generally, the total internal volume of the chamber 55 or 63 and the conduits leading to the pump is sized much smaller the load volume Vs, including tanks and other conduits, to ensure rapid pump relief and load pressure or vacuum correction. The working valve port 26 or 65 should be sized large enough to minimize pressure drop across the port when the valves are in the working position.

The load volume Vs is large. While the pump is relieved, the large capacitance of the load volume will hold the load pressure or vacuum level within a tolerable range for a period of time depending on the overall volume of the load, the fluid usage by the system, and the regulator sensitivity. For a pneumatically or mechanically operated design of the regulator, the sensitivity depends on the friction resisting the motion of the movable elements. In the preferred embodiments, the friction resisting the motion of the shuttle valve 46 or 82 is the dominant factor and, therefore, can be adjusted to obtain desirable regulator sensitivity. For a solenoid-operated design, the regulator sensitivity can be adjusted electrically or electronically.

When the load pressure or vacuum is below a set point of reference, the regulator enters its work status. Because the volume of the internal chamber of the regulator is small, the pressure (or vacuum in the chamber) will quickly rise to pull the system pressure or vacuum up. The system can be adapted to different setpoints, regulator sensitivities, and sizes as desired.

As shown in FIG. 4, a substantial proportion of energy consumed by fluid systems can be saved with the present device over that of a conventional regulator, especially when the load fluid usage is quite variable with much time at low levels. The regulator can be used to advantage in vacuum systems such as milking machines. In such machines the pump is running all the time so that the energy consumption during non-use of the system is quite high if the pump is not relieved. It is not feasible to turn the pump on and off, because of the load demand cycle, and thus the present regulator operates well to conserve energy. Any pneumatic systems with reserve tanks and substantial volumes, such as those used in medical, manufacturing, food and agricultural industries, can benefit from the present regulator.

Although the present invention has been described with reference to preferred embodiments, workers skilled in the art will recognize that changes may be made in form and detail without departing from the spirit and scope of the invention.

What is claimed is:

1. A fluid system including a pump, a fluid load and a regulator between the pump and load, said regulator comprising a first port to the load, a second port to the pump, and an auxiliary port to an ambient pressure; first and second valves for controlling flow through the first port and auxiliary port, respectively, the second valve being closed when the pump is moving fluid and the load is in other than a selected fluid condition, an actuator for moving the second valve to connect the pump to the ambient pressure through the regulator when the load is in a first selected fluid condition, the first valve closing under fluid forces when the second valve opens to relieve the load on the pump, the second valve being closed and the first valve open when the fluid condition of the load reaches a second selected fluid condition.

2. The fluid system of claim 1 wherein the first and second fluid conditions are fluid pressure levels.

3. The fluid system of claim 2 where the pressure levels are negative fluid pressures relative to ambient pressure.

4. The fluid system of claim 2 where the pressure levels are positive fluid pressure levels relative to ambient pressure.

5. The fluid system of claim 1 wherein the load comprising a reservoir for fluid maintained at a pressure differential from ambient pressure by the pump.

6. The fluid system of claim 1 wherein the second valve is actuated by a diaphragm connected to the second valve, said diaphragm being controlled by an operator sensing fluid pressure of the load and opening the second valve when the pressure of the load reaches a desired pressure level.

7. The fluid system of claim 1 wherein the ambient pressure is atmospheric pressure.

8. The fluid system of claim 1 wherein the regulator comprises a valve housing defining a chamber, the chamber having the first port, the second port and auxiliary port open thereto, the first valve comprising a pressure responsive valve which opens and closes under pressure differential between the load and the chamber.

9. The fluid system of claim 8 wherein a change in fluid pressure in the chamber results when the second valve opens, which causes the first valve to close and remove the pressure differential on the pump.

10. A regulator for conserving energy consumed by a fluid pump having first and second connections and which consumes energy as a function of a differential pressure between the first and second connections, said regulator comprising;

a housing having an internal chamber, a first connection adapted to be connected to one of the connections of the pump and open to the chamber;

a second port forming a load connection open to the chamber;

a work valve member controlling fluid flow through said second port in response to pressure differential between the chamber and the load connected to the load connection; and a relief port open to the chamber;

a relief valve mounted to control flow through said relief port and being in an opposite state from the work valve, said relief valve being open to an ambient pressure that forms a relief pressure that is substantially equal to the pressure at the second connection of a pump connected to the regulator; and means to control opening of the relief valve and closing of the work valve in response to fluid a condition of the load.

11. The regulator of claim 10 wherein the volume of the chamber in the regulator is selected to be substantially smaller than the volume of a load connected to the load connection.

12. The regulator of claim 10 wherein said relief valve has a control diaphragm attached thereto, said control diaphragm being mounted on the regulator and closing off a control chamber, and a shuttle spool valve for regulating the pressure in said control chamber to provide a control pressure to open the relief valve when the system pressure achieves a desired level.

13. The regulator of claim 10 wherein said work valve is sensitive to pressure differentials between the chamber and the load, whereby opening of the relief valve will cause the work valve to close because of changes in pressure in the chamber.

14. The regulator of claim 10 wherein said ambient pressure is atmospheric pressure.

15. The regulator of claim 10 wherein said regulator is for controlling vacuum being applied to a load, and the connection of the regulator to the pump is a vacuum connection, and said relief valve being moved to an open position when the vacuum level in the load is a selected amount below ambient pressure.

16. The regulator of claim 10 wherein said load comprises a positive fluid pressure load, and the connection of the regulator to the pump is to a pressure connection of the pump, said work valve being opened by a higher pressure in the chamber than in the load.

* * * * *